US006128869A

United States Patent [19]

Brotherton et al.

[11] Patent Number: 6,128,869

[45] Date of Patent: Oct. 10, 2000

[54] MULTI-BAFFLED ROOF RIDGE VENT

[75] Inventors: Mark Brotherton, St. Marys, Ohio; James Hanenburg, Coopersville, Mich.

[73] Assignee: Milcor Limited Partnership, Lima, Ohio

[21] Appl. No.: 09/307,304

[22] Filed: May 7, 1999

[51] Int. Cl.[7] ..... E04D 13/17

[52] U.S. Cl. ..... 52/198; 52/199; 52/302.1

[58] Field of Search ..... 52/198, 302.1, 52/199; 454/365

[56] References Cited

U.S. PATENT DOCUMENTS 5,535,558 7/1996 Rieke et al. ..... 52/302.1 X
5,673,521 10/1997 Coulton et al. ..... 52/198 X

OTHER PUBLICATIONS

Ridge Vent Drawing No. 25850 dated Feb. 6, 1993.

*Primary Examiner*—Christopher T. Kent
*Attorney, Agent, or Firm*—MacMillan, Sobanski & Todd, LLC

[57] ABSTRACT

A roof ridge vent for covering longitudinal vents cut through a roof on opposite sides of a ridge board, the roof ridge vent comprising: a planar cover configured to straddle the ridge board. The planar cover has a first edge and a second edge on opposite sides of the ridge board. A first row of spaced apart baffles are positioned parallel to the first edge and a first row of spaced apart baffles are positioned parallel to the second edge. A second row of spaced apart baffles are positioned parallel to the first row of baffles adjacent the first edge and a second row of spaced apart baffles are positioned parallel to the first row of baffles adjacent the second edge. A row of spaced apart posts are positioned parallel to the second row of baffles at the first edge and a row of spaced apart posts are positioned parallel to the second row of baffles at the second edge. The first rows of spaced apart baffles, the second rows of spaced apart baffles, and the rows of spaced apart posts are positioned on the planar cover to contact the roof and hold the planar cover over said longitudinal vents.

19 Claims, 5 Drawing Sheets

MULTI-BAFFLED ROOF RIDGE VENT

BACKGROUND OF THE INVENTION

The present invention relates generally to roof vents. More specifically, the present invention relates to an improved roof ridge vent that permits voluminous airflow out of the attic space yet is configured to prevent the entry of insects and water.

It is well known that in order for an attic space to function optimally, there must be adequate air flow to keep the air temperature in the attic close to the outside air temperature. In addition, adequate air flow assures that moisture that migrates out of interior spaces and through the insulation does not remain trapped in the attic space and re-condense on or in the attic insulation.

In order to provide such air flow a variety of vents have been developed. Such vents are typically placed at the bottom of the roof, under the eaves, and somewhere in the upper part of the roof Passive vents in which air is exhausted as a result of convective currents in the attic, such as pot vents (a pipe covered by a protective dome) or goosenecks (a curved pipe) are commonly used. Because such passive vents often move inadequate amounts of air, powered vents (a pot vent with a fan) or an attic fan (a fan positioned under an eave) are sometimes installed to increase attic air flow.

One of the most effective kinds of upper vents that works solely as a result of convection is a ridge vent, i.e. a vent placed near or at the ridge or peak of the roof. The most effective ridge vents are vents that run the full length of the roof peak.

A variety of full length roof ridge vents are known in the art. These generally consist of a covered ventilation cap over a vent opening extending along the ridge of the roof. The ventilation cap is held spaced apart from the vent opening using spacers such as springs or posts. Typically, a baffle system is included to prevent water from being blown from the outside into the attic space and a porous material (such as foam rubber, or non-woven insulation) is provided between the vent opening and the spacers and/or baffles to prevent insects from getting into the attic space.

The prior art materials have a variety of drawbacks. The use of porous material adds additional expense to manufacturing because of increased material and assembly costs. Further, in the winter, water will condenses and freeze on the porous material, blocking air flow through the vent. Over time, successive freezing/thawing cycles breech the porous materials and create passages and nesting sites for insects. In addition, current baffles are complex and expensive to manufacture and/or not optimized to prevent rain and/or snow from being blown into the attic.

Thus, it would be desirable to have a roof ridge vent that could be easily and inexpensively manufactured that would effectively permit the passage of moisture laden air in summer and winter, while at the same time excluding insects and wind blown rain and/or snow.

SUMMARY OF THE INVENTION

This invention relates to an improved roof ridge vent for covering longitudinal vents cuts through a roof on opposite sides of a ridge board to permit convective venting of air from the attic space and prevent entry of insects and water. A roof ridge vent of the invention comprises a planar cover configured to straddle the ridge board. The planar cover has a first edge and a second edge on opposite sides of the ridge board. A first row of spaced apart baffles are positioned parallel to the first edge and a first row of spaced apart baffles are positioned parallel to the second edge. A second row of spaced apart baffles are positioned parallel to the first row of baffles adjacent the first edge and a second row of spaced apart baffles are positioned parallel to the first row of baffles adjacent the second edge. A row of spaced apart posts are positioned parallel to the second row of baffles at the first edge and a row of spaced apart posts are positioned parallel to the second row of baffles at the second edge. The first rows of spaced apart baffles, the second rows of spaced apart baffles, and the rows of spaced apart posts are positioned on the planar cover to contact the roof and hold the planar cover over said longitudinal vents.

Various objects and advantages of this invention will become apparent to those skilled in the art from the following detailed description of the preferred embodiment, when read in light of the accompanying drawings.

BRIEF DESCRIPTION OF THE DRAWINGS

FIG. 3 is a perspective view showing the arrangements of the first rows of baffles, the second rows of baffles, and the rows of spaced apart posts that illustrates how the positioning of the baffles and posts permits air to flow out and prevents water and insects from going in.

DESCRIPTION OF THE PREFERRED EMBODIMENT

Figure 1:
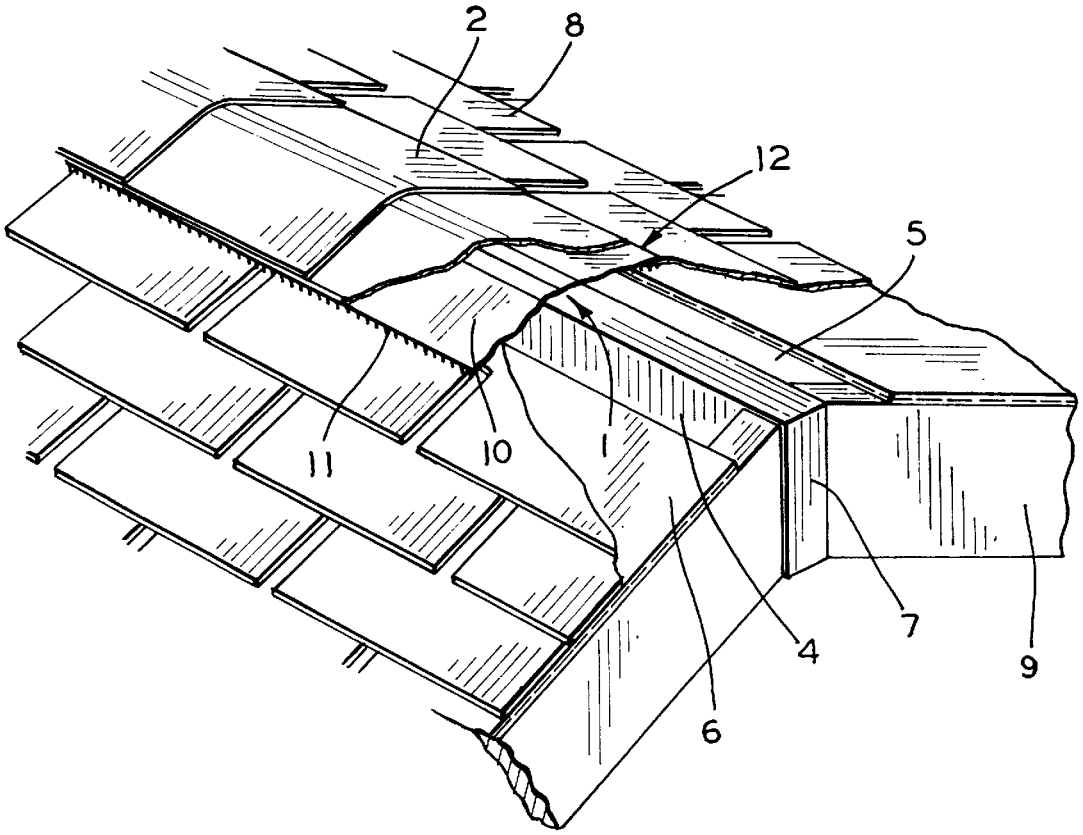
FIG. 1 is a perspective view of a ridge vent according to the invention positioned to cover a longitudinal vent opening formed on either side of a ridge board.

Referring to the drawings, FIG. 1 illustrates a portion of a ridge of a peaked roof. The supporting structure of a conventional peaked roof is composed of pairs of opposing rafters 9 joined to a ridge board 7.

In most modern construction, large sheets of manufactured material, such as plywood, OSB board, etc. are used as roof boards 6 to bridge between adjoining rafters 9. Flashing (not shown) or roofing "felt" such as an asphalt impregnated material is routinely laid over the roof boards 6 to prevent any moisture that might leak around the shingles 8 from penetrating into the attic and interior area of the building. The outermost layer of a roof commonly consists of shingles 8, formed from fiberglass, cedar, stone, etc. secured on top of the flashing or felt. Shingles 8 are typically placed from the bottom of the roof to the ridge or peak such that successive rows of shingles up the roof and including the ridge cap 2 overlap proceeding shingles thereby directing water off the roof. (Other less common exterior roofing materials such as sheets of tin, steel, copper, etc. are arranged in an analogous manner. While the present invention is illustrated in FIG. 1 as installed beneath a shingled roof, this is in no way intended to limit the invention which can be used to provide a ridge vent on any peaked roof fabricated with any type of building materials.) To use a ridge vent, gaps 4, 5 are left (or cut if a new roof is being installed on an existing structure) in the roof board 6 on either side of the ridge board 7.

FIG. 1 illustrates a roof ridge vent 1, positioned over gaps 4, 5 that form longitudinal vents on opposite sides of the ridge board 7. Shingles 8 are laid up to the edge of the ridge vent 1 and a ridge cap 2 laid overtop of the ridge vent 1. The roof ridge vent 1 according to the invention comprises a planar cover 10 configured to straddle the ridge board 7. The planar cover 10 has a first edge 11 and a second edge 12. When positioned over the ridge board 7, the first edge 11 and the second edge 12 fall on opposite sides of the ridge board 7. Rows of baffles and posts (described in detail below) are positioned on the underside of the planar surface 10 facing the longitudinal vents 4, 5 and generally parallel to the first edge 11 and the second edge 12. These rows of baffles and posts are positioned on the planar cover to contact the roof and hold the planar cover over the longitudinal vents spaced apart from the surface of the roof. This permits air to flow out of the attic space through the vents 4, 5 and blocks water and insects from getting into the attic space through the vents 4, 5.

Figure 2:
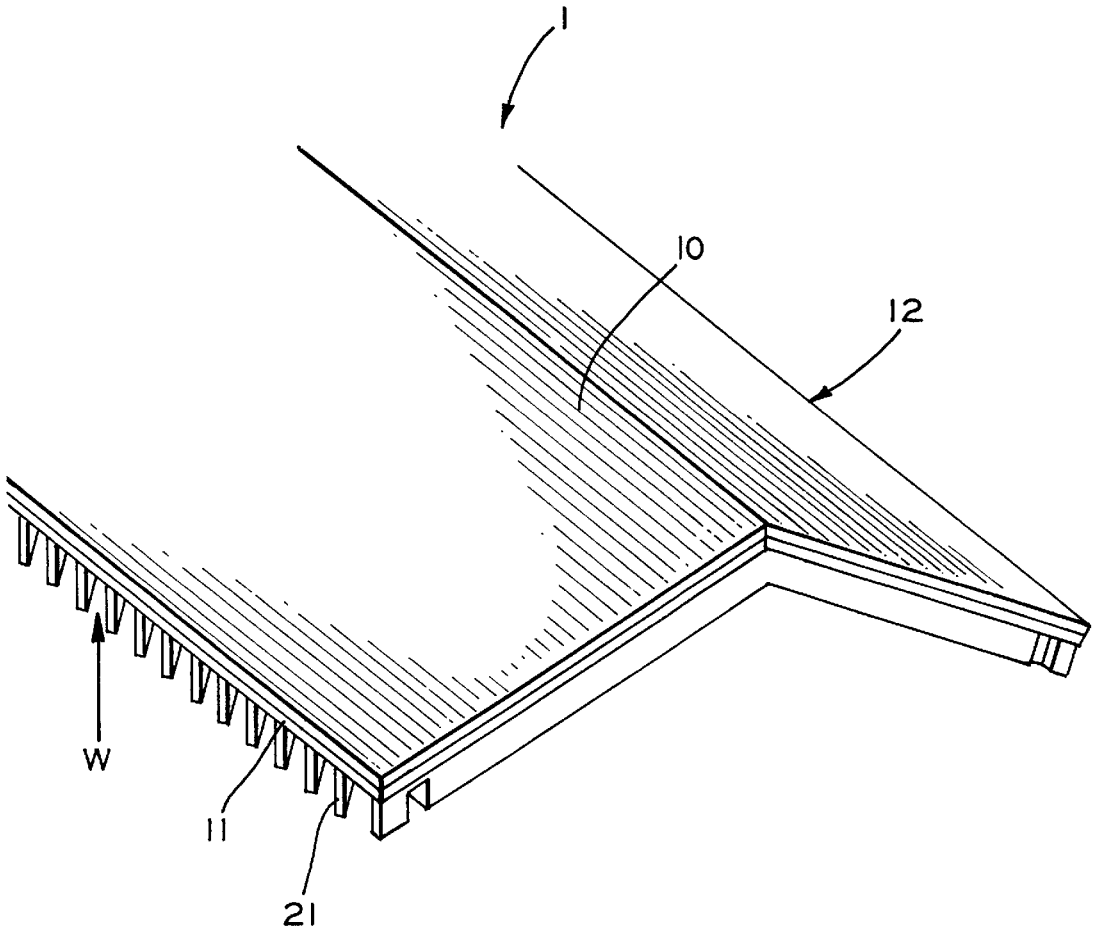
FIG. 2 is an enlarged perspective view of a ridge vent as installed in FIG. 1 showing the first row of baffles.

FIG. 2 is an enlarged view of the ridge vent according to the invention as installed on a roof as shown in FIG. 1. Visible in greater detail are the first edge 11 and the first row of baffles 12.

Figure 3:
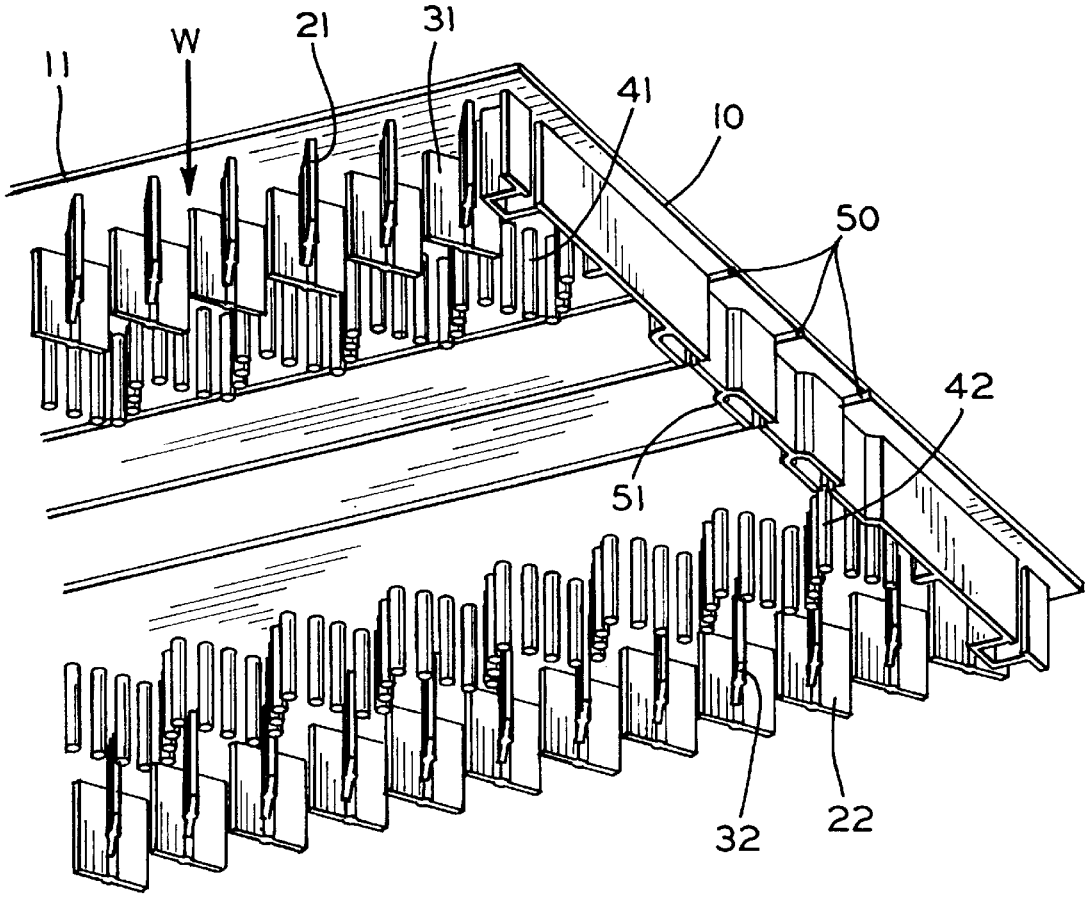
Figure 4:
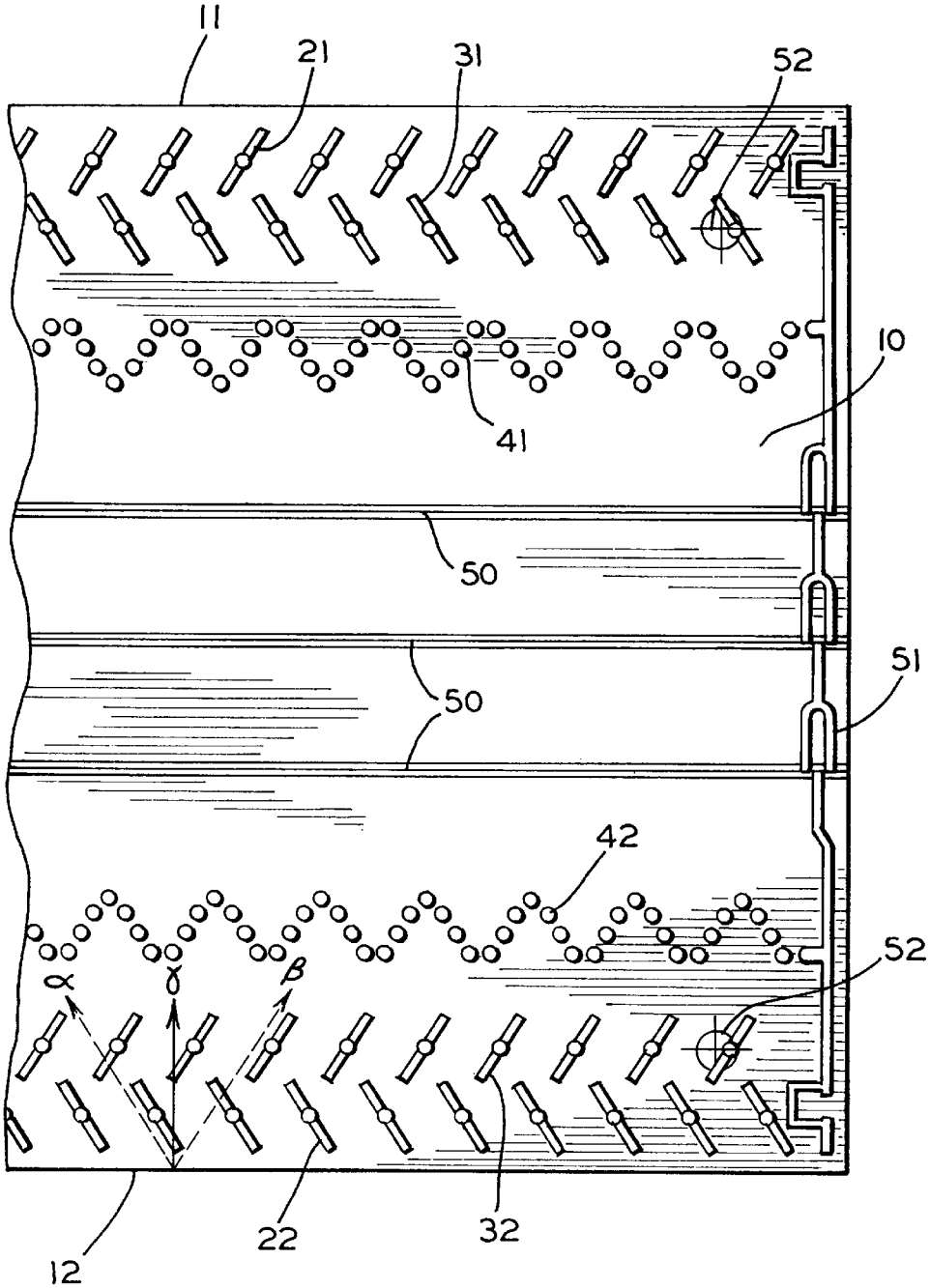
FIG. 4 is a bottom plan view of the ridge vent of FIG. 1 showing the location of a first row of spaced apart baffles parallel to the first and second edge of the ridge vent, a second row of spaced apart baffles parallel to the first rows of baffles and parallel to the first and second edges, and rows of spaced apart posts parallel to the second rows of baffles at the first and second edges.

FIG. 3 illustrates the ridge vent of FIG. 1, prior to installation on the roof. As illustrated in FIGS. 3 and 4, a first row of spaced apart baffles 21 are positioned parallel to the first edge 11 of the planar cover 10, a second row of spaced apart baffles 31 are positioned parallel the first row of spaced apart baffles 21 and, a row of spaced apart posts 41 are positioned generally parallel to the second row of spaced apart baffles 31. Similarly, a first row of spaced apart baffles 22, a second row of spaced apart baffles 32, and a row of spaced apart posts 42 are positioned parallel to the second edge 12 of the planar cover 10. Generally, the first row, second row, and posts closest to the second edge are a mirror image of the first row, second row, and posts closest to the first edge. However, nothing included herein is intended to preclude variations in this configuration.

A particular aspect of the invention visible in FIG. 3 is the positioning of the first rows of baffles 21, 31 with the second rows of baffles 22, 32. The first rows of baffles 21, 31 are offset from the second row of baffles 22, 32. The use of two parallel rows of baffles maximizes the number of openings for convectively driven attic air to exit the attic space. At the same time, the offset blocks any direct path between the rows of baffles 21, 31 and 22, 32. As shown in FIGS. 2 and 3, if in a course of a rainstorm the wind was blowing in the direction indicated by arrow W, that is parallel to the first row of baffles 21, 22, water carried by this wind would be stopped by the offset baffles 31, 32 (see, FIG. 3) and thereby prevented from being blown through the vent 4 or 5 and into the attic space. Wind blowing in any other direction, would be blocked by a portion of the first row of baffles 21, 22 and a portion of the second row of baffles 31, 32.

As shown more clearly in FIG. 4, each of the spaced apart baffles in the first rows are parallel planar vanes each of which is positioned at a first angle $\alpha$ relative to the first edge 11 or the second edge 12. Similarly, each of the spaced apart baffles in the second rows of baffles is a planar vane which is positioned at a second angle $\beta$ relative to the first edge 11 and said second edge 12.

If a perpendicular line $\gamma$ is drawn as shown in FIG. 4 from the second edge 12 (or the first edge 11) a quadrant is defined on either side of the line $\gamma$ and the second edge 12 (or the first edge 11). In the present invention, the first angle $\alpha$ is in one of these two quadrants and the second angle $\beta$ is in the opposite quadrant. (This relationship is referred to hereinafter as "the first angle and the second angle are opposite angles.")

In the present invention, the first angle $\alpha$ and the second angle $\beta$ may be any convenient angle so long as the first angle $\alpha$ and second angle $\beta$ are opposite angles as defined above, and the first angle $\alpha$ and second angle $\beta$ (as well as the overall positioning of the first rows 21, 31 of baffles relative to the second rows 22, 32 of baffles) are chosen so that any wind/rain flowing between the first rows of spaced apart baffles is prevented from reaching the vents 4, 5 by the second rows of spaced apart baffles. That is fluid (be it water, air, or a mixture of water and air) entering between the first rows 21, 31 of baffles contacts a planar surface of the individual baffles in the second rows 22, 32 of baffles.

In the embodiment of the present invention illustrated in FIG. 4, each baffle in the first rows 21, 31 is a planar vane positioned at a first angle $\alpha$ and each baffle in the second rows 22, 32 is a planar vane positioned at a second angle $\beta$ where the second angle $\beta$ is equal and opposite to said first angle $\alpha$. As used herein, the phrase "equal and opposite" means that if the first angle $\alpha$ is X° up from the first edge 11 or the second edge 12 in a quadrant defined by a line $\gamma$ perpendicular to the first edge 11 or second edge 12, then the second angle $\beta$ is X° up from the first edge 11 or the second edge 12 in the opposite quadrant.

In the present invention, the first angle $\alpha$ may be between 35 degrees and 85 degrees from the first edge 11 or the second edge 12, and the second angle $\beta$ may be between 35 degrees and 85 degrees from the first edge 11 or the second edge 12. Preferably, the first angle $\alpha$ may be between 45 degrees and 75 degrees from the first edge 11 or the second edge 12, and the second angle $\beta$ may be between 45 degrees and 75 degrees from the first edge 11 or the second edge 12. Most preferably, the first angle $\alpha$ is about 60 degrees from the first edge 11 or the second edge 12, and the second angle $\beta$ is about 60 degrees from the first edge 11 or the second edge 12.

It is most preferred that the first angle $\alpha$ and the second angle $\beta$ are chosen to simultaneously provide maximum venting of air from the attic space and maximum protection against entry of water, or water and air. Obviously, the chosen angle would take into consideration the local climate (hot and dry in the desert Southwest, mild and wet in the Pacific Northwest, hot and wet in the Southeast, etc.). It is also intended that more localized factors be considered such as the position of the roof relative to prevailing winds when installing a roof ridge vent according to the present invention. For example, in the desert Southwest, it is preferred that the roof ridge vent be installed so that the first row of baffles 21 are positioned approximately parallel to the prevailing winds so that these winds can aid in moving air out of the attic space. In contrast in the southeast, it is preferred that the roof ridge vent be installed so that the first row of baffles 21 are positioned approximately perpendicular to the prevailing winds to prevent the maximum surface against infiltration by water carried by these winds.

An additional unique aspect of the present invention is a row of spaced apart posts 41, 42 parallel to the second row of baffles at the first edge 11 or the second edge 12. The posts of the present invention are specifically designed to prevent insect infiltration into the attic space through the roof ridge vent. These posts represent a significant improvement over the prior art method of blocking insect infiltration by inserting a strip of porous batting, such as fiberglass insulation, into the ridge vent. Further, the row of posts are fabricated at the same time and using the same materials as the rest of the ridge vent, thereby speeding fabrication and reducing overall costs.

The row of spaced apart posts 41, 42 may be arranged in any manner where the space between the individual posts are such that insects cannot pass between the spaced apart posts. In addition, the overall arrangement of the posts form a row approximately parallel to the second row of baffles and the first edge 11 or second edge 12. (This positioning can be visualized in FIG. 4, by imaging parallel lines drawn to contain the posts.) It is preferred that the posts are arranged in a zigzag pattern as shown in FIGS. 3 and 4.

Figure 5:
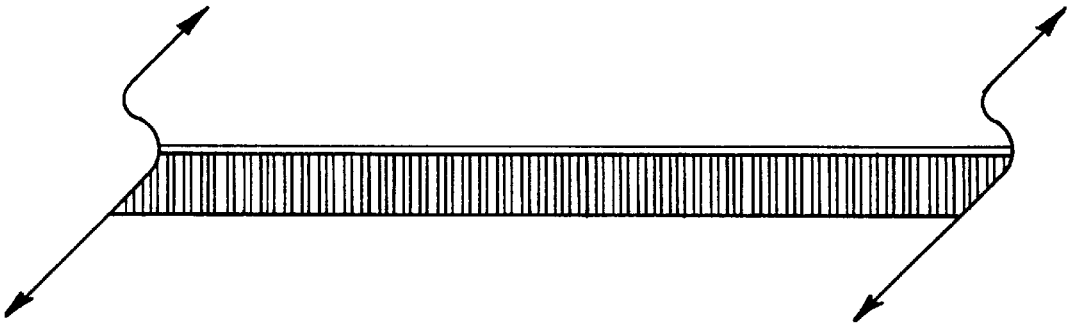
FIG. 5 is a side plan view showing the outer edges of the first rows of baffles along one longitudinal edge.

FIG. 5 is a side plan view showing the outer edges of the first rows of baffles along one longitudinal edge. This view illustrates the barrier presented by the present invention to infiltration by water and insects as well as the number of spaces that permit the effective convective flow of air out of the attic space.

Overall, the first row of baffles, the second row of baffles, and the row of posts are configured to permit airflow outward through the longitudinal vents 4, 5 and prevent inflow of water and insects.

In order to simplify installation, a ridge vent according to the present invention may be fabricated having preformed bend lines 50 (as shown in FIGS. 3 and 4) and formed nail or screw points 52. In addition, the planar cover 10 further comprises a third edge and a fourth edge parallel to each other and perpendicular to the first edge and the second edge. The third edge and the fourth edge are fabricated with interlocking portions to permit a plurality of roof ridge vent sections to be joined together to form a continuous roof ridge vent of indefinite length.

To install a roof ridge vent of the present invention over vents 4, 5, a contractor takes an appropriate number of vents and snaps the interlocking portions 51 on the third and fourth edges together to form a continuous section of ridge vent long enough to run the length of the ridge board 7 covering the gaps 4, 5. The contractor then secures this continuous section in place using appropriate fasteners through the screw points 52 so that the bend lines are appropriately positioned over the ridge board 7. Finally, the contractor secures the shingles 8 up to the ridge vent 1 and covers the ridge vent with the ridge cap 2.

A ridge vent of the present invention may be formed from any convenient material such as metal or plastic. Preferably, the ridge vent is formed from a thermoplastic or mixture of thermoplastics. Preferably, the thermoplastic is chosen form the group consisting of polystyrenes, polyethylenes, polyvinyls, polypropylenes, and polyamides. Most preferably, a ridge vent according to the invention is formed from copolymer polypropylene.

Any convenient means may be used to form a ridge vent according to the present invention such as blow molding or injection molding. The preferred fabrication method is injection molding.

In summary, a roof ridge vent 1 according to the present invention covers longitudinal vents 4, 5 cut through a roof on opposite sides of a ridge board 7. The roof ridge vent 1 comprises a planar cover 10 configured to straddle the ridge board 7. The planar cover 10 has a first edge 11 and a second edge 12 on opposite sides of the ridge board 7. Positioned on the planar cover 10 facing longitudinal vents 4, 5 are rows of baffles and posts. More specifically, a first row of spaced apart baffles 21 is arranged parallel to the first edge 11 and a first row 22 of spaced apart baffles is arranged parallel to the second edge 12. A second row of spaced apart baffles 31 is arranged parallel to the first row of baffles 21 adjacent the first edge 11 and a second row 32 of spaced apart baffles is arranged parallel to the first row of baffles 22 adjacent the second edge 12. A row of spaced apart posts 41 is positioned parallel to the second row 31 of baffles at the first edge 11 and a row of spaced apart posts 42 is positioned parallel to the second row 42 of baffles at the second edge 12. The first rows 21, 22 of spaced apart baffles, the second rows 31, 32 of spaced apart baffles, and the rows 41, 42 of spaced apart posts support the planar cover 10 spaced apart from the roof 6.

While the present invention is described as having a first row of baffles, a second row of baffles, and a row of posts positioned inwardly from the outside edges, the invention also includes variations consistent with the disclosure. For example in addition to the baffles-baffles-posts arrangement as described, the baffles and posts may be arranged as follows: posts-baffles-baffles or baffles-posts-baffles. Further additional rows of baffles and posts may be used such as follows: posts-baffles-baffles-posts, baffles-posts-baffles-posts, posts-baffles-posts-baffles, etc.

In addition, while the specific size and spacing between the individual baffles has not been specifically described, any size and spacing may be used that is in accordance with the above description, that permits sufficient air flow out of the attic space, and prevents entry of insects and water.

Further, while illustrated on a roof having a longitudinal peak with the roof surface sloping away from this peak at approximately equal angles on either side, embodiments of the present invention may also be used to provide ventilation on any sloping roof surface.

The principle and mode of operation of this invention have been explained and illustrated in a preferred embodiment. However, it must be understood that this invention may be practiced otherwise than as specifically explained and illustrated without departing from its spirit or scope.

What is claimed is:

1. A roof ridge vent for covering longitudinal vents cut through a roof on opposite sides of a ridge board, said roof ridge vent comprising:

a cover having a first generally longitudinally extending edge and a second generally longitudinally extending edge adapted to be disposed on opposite sides of the ridge board;

a first row of spaced apart baffles extending generally longitudinally adjacent to said first edge and a first row of spaced apart baffles extending generally longitudinally adjacent to said second edge;

a second row of spaced apart baffles extending generally longitudinally adjacent to said first row of baffles adjacent to said first edge and a second row of spaced apart baffles extending generally longitudinally adjacent to said first row of baffles adjacent to said second edge; and a row of spaced apart posts extending generally longitudinally adjacent to said second row of baffles adjacent to said first edge and a row of spaced apart posts extending generally longitudinally adjacent to said second row of baffles adjacent to said second edge;

said first rows of spaced apart baffles, said second rows of spaced apart baffles, and said rows of spaced apart posts adapted to contact the roof and support the cover over the longitudinal vents.

2. The roof ridge vent defined in claim 1 wherein said first row of spaced apart baffles adjacent to said first edge is a row of parallel planar vanes.

3. The roof ridge vent defined in claim 2 wherein said parallel planar vanes are positioned at a first angle relative to said first edge.

4. The roof ridge vent defined in claim 1 wherein said first row of spaced apart baffles adjacent to said first edge is a first row of parallel planar vanes, and wherein said second row of spaced apart baffles adjacent to said first edge is a second row of parallel planar vanes.

5. The roof ridge vent defined in claim 4 wherein said parallel planar vanes in said first row are positioned at a first angle relative to said first edge, and wherein said parallel planar vanes in said second row are positioned at a second angle relative to said first edge.

6. The roof ridge vent defined in claim 5 wherein said first angle and said second angle are opposite angles.

7. The roof ridge vent defined in claim 1 wherein said first angle and said second angle are equal and opposite angles.

8. The roof ridge vent defined in claim 1 wherein said first row of spaced apart baffles adjacent to said first edge is a first row of parallel planar vanes, and wherein said first row of spaced apart baffles adjacent to said second edge is a second row of parallel planar vanes.

9. The roof ridge vent defined in claim 8 wherein said parallel planar vanes in said first row are positioned at a first angle relative to said first edge, and wherein said parallel planar vanes in said second row are positioned at a second angle relative to said second edge.

10. The roof ridge vent defined in claim 8 wherein said second row of spaced apart baffles adjacent to said first edge is a third row of parallel planar vanes, and wherein said second row of spaced apart baffles adjacent to said second edge is a fourth row of parallel planar vanes.

11. The roof ridge vent defined in claim 10 wherein said parallel planar vanes in said first row are positioned at a first angle relative to said first edge, said parallel planar vanes in said second row are positioned at a second angle relative to said second edge, parallel planar vanes in said third row are positioned at a third angle relative to said first edge, and said parallel planar vanes in said fourth row are positioned at a fourth angle relative to said second edge.

12. The roof ridge vent defined in claim 11 wherein said first angle and said third angle are opposite angles.

13. The roof ridge vent defined in claim 11 wherein said first angle and said third angle are equal and opposite angles.

14. The roof ridge vent defined in claim 11 wherein said first angle and said third angle are opposite angles, and wherein said second angle and said fourth angle are opposite angles.

15. The roof ridge vent defined in claim 11 wherein said first angle and said third angle are equal and opposite angles, and wherein said second angle and said fourth angle are equal and opposite angles.

16. The roof ridge vent defined in claim 1 wherein said cover is formed from a thermoplastic material.

17. The roof ridge vent defined in claim 16 wherein said thermoplastic material is chosen form the group consisting of polystyrenes, polyethylenes, polyvinyls, polypropylenes, and polyamides.

18. The roof ridge vent defined in claim 1 wherein said cover is formed from copolymer polypropylene.

19. The roof ridge vent defined in claim 1 wherein rows of spaced apart posts are arranged in a zigzag pattern extending generally longitudinally adjacent to said second rows of baffles.

* * * * *